US008550611B2

(12) United States Patent
Alavizadeh et al.

(10) Patent No.: US 8,550,611 B2
(45) **Date of Patent: *Oct. 8, 2013**

(54) HEAT ELEMENT CONFIGURATION FOR A RESERVOIR HEATER

(75) Inventors: Nasser Alavizadeh, Tigard, OR (US); Christopher Jon Laharty, Oregon City, OR (US); Chad Johan Slenes, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/346,142

(22) Filed: Jan. 9, 2012

(65) Prior Publication Data

US 2012/0113196 A1 May 10, 2012

Related U.S. Application Data

(62) Division of application No. 12/355,965, filed on Jan. 19, 2009, now Pat. No. 8,092,000.

(51) Int. Cl.
*B41J 2/175* (2006.01)

(52) U.S. Cl.
USPC ..... 347/88; 219/552; 338/331; 347/62

(58) Field of Classification Search
USPC ..... 347/88, 61–65; 219/552; 338/331
See application file for complete search history.

(56) References Cited

U.S. PATENT DOCUMENTS 5,635,964 A 6/1997 Burr et al.
6,239,820 B1 * 5/2001 Figueredo et al. ..... 347/50
7,300,143 B2 11/2007 Slotto et al.
2003/0202050 A1 * 10/2003 Mrvos et al. ..... 347/64
2005/0146584 A1 7/2005 Godil et al.
2006/0176347 A1 8/2006 Hong et al.
2008/0041843 A1 2/2008 Bower et al.

FOREIGN PATENT DOCUMENTS

EP 1688260 8/2006

OTHER PUBLICATIONS

European Search Report corresponding to European Patent Application 10151071, European Patent Office, Munich, Germany, May 27, 2010 (7 pages).

* cited by examiner

*Primary Examiner* — Julian Huffman
*Assistant Examiner* — Sharon A Polk
(74) *Attorney, Agent, or Firm* — Maginot, Moore & Beck, LLP

(57) ABSTRACT

A heater for use in a phase change ink printhead reservoir is provided that includes a first insulating layer having at least one ink supply path opening, and a second insulating layer having at least one ink supply path opening that aligns with the at least one ink supply path opening in the first insulating layer. The heater includes a resistance heating trace arranged in a serpentine pattern between the first and the second insulating layers. The resistance heating trace is configured to receive electric current and to convert the electric current to heat. The resistance heating trace includes a trace ring for each ink supply path opening in the first and second insulating layers that forms a continuous perimeter around the corresponding ink supply path opening.

6 Claims, 8 Drawing Sheets

HEAT ELEMENT CONFIGURATION FOR A RESERVOIR HEATER

CLAIM OF PRIORITY

This application is a divisional application of and claims priority to copending U.S. patent application having Ser. No. 12/355,965, which was filed on Jan. 19, 2009 and is entitled "Heat Element Configuration For A Reservoir Heater," and which will issue as U.S. Pat. No. 8,092,000 on Jan. 10, 2012.

TECHNICAL FIELD

This disclosure relates generally to phase change ink jet imaging devices, and, in particular, to methods and devices for heating printheads used in such imaging devices.

BACKGROUND

Solid ink or phase change ink printers conventionally receive ink in a solid form, either as pellets or as ink sticks. The solid ink pellets or ink sticks are typically inserted through an insertion opening of an ink loader for the printer, and the ink sticks are pushed or slid along a feed channel by a feed mechanism and/or gravity toward a solid ink melting assembly. The melting assembly melts the solid ink into a liquid that is delivered to a melted ink container. The melted ink container is configured to hold a quantity of melted ink and to communicate the melted ink to one or more printhead reservoirs located proximate at least one printhead of the printer as needed.

Printhead reservoirs may be formed of a plurality of plates or panels that are bonded or adhered to each other and include openings that align to form ink supply paths that direct ink from the melted ink container toward the ink jets of the printhead. One of the panels of the printhead reservoirs is typically configured to serve as a heater for the printhead reservoir to heat the reservoir in order to maintain the phase change ink therein in liquid or melted form.

To prevent ink from leaking out of the ink supply paths, the adhesive bond or seal between the heater and adjacent reservoir plates must be continuous around the ink supply path openings in the plates. Non-planar surface topography, such as raised or recessed areas, around an ink supply path opening of the heater may result in poor adhesion or bonding between the heater and the adjacent reservoir plates around the ink supply path opening which, in turn, may allow ink traveling along the ink supply path to seep between the plates. Ink leaking out of a supply path and getting between the heater and an adjacent reservoir plate, which may adversely impact the life of a printhead.

SUMMARY

In order prevent ink leakage from an ink supply path in a printhead reservoir, a heater has been developed that includes a resistance heater element that has been configured to promote adhesion between the heater and adjacent reservoir plates around the ink supply path openings in the heater and the adjacent plates. In particular, a heater for use in a phase change ink printhead reservoir includes a first insulating layer having at least one ink supply path opening, and a second insulating layer having at least one ink supply path opening that aligns with the at least one ink supply path opening in the first insulating layer. The heater includes a resistance heating element between the first and the second insulating layers configured complementary to porting and thickness uniformity between plates. The resistance heating trace is configured to receive electric current and to convert the electric current to heat. The resistance heating element includes material surrounding each ink supply path opening in the first and second insulating layers that forms a continuous perimeter around the corresponding ink supply path opening.

In another embodiment, a reservoir assembly for use in a phase change ink imaging device is provided that includes a back plate including an ink input port configured to receive liquid ink from an ink source; and a front plate including an ink tank configured to hold ink received from the ink source and to communicate the ink to a printhead. A first heat distribution plate is adhered to the back plate; and a second heat distribution plate is adhered to the front plate. A heater is adhered between the first and the second heat distribution plates. The heater, the first heat distribution plate, and the second heat distribution plate each include an ink supply path opening that aligns with the other ink supply path openings to form an ink supply path configured to guide ink from the ink input port to the ink tank. The heater includes first insulating layer having at least one ink supply path opening, and a second insulating layer having at least one ink supply path opening that aligns with the at least one ink supply path opening in the first insulating layer. The heater includes a resistance heating element placed between the first and the second insulating layers. The resistance heating element is configured to receive electric current and to convert the electric current to heat. The resistance heating element includes material encircling each ink supply path opening in the first and second insulating layers that forms a continuous perimeter around the corresponding ink supply path opening.

In yet another embodiment, a printer is provided that includes a melted ink container configured to hold a quantity of melted phase change ink; and a printhead configured to eject melted phase change ink onto an imaging member. The printer includes a reservoir assembly having a back plate including an ink input port configured to receive liquid ink from the melted ink container; a front plate including an ink tank configured to hold ink received from the melted ink container and to communicate the ink to the printhead; a first heat distribution plate adhered to the back plate; a second heat distribution plate adhered to the front plate; and a heater adhered between the first and the second heat distribution plates. The heater, the first heat distribution plate, and the second heat distribution plate each includes an ink supply path opening that aligns with the other ink supply path openings to form an ink supply path configured to guide ink from the ink input port to the ink tank. The heater includes a first insulating layer having a uniform thickness at least around the ink supply path opening; a second insulating layer having a uniform thickness at least around the ink supply path opening; and a resistance heating element placed between the first and the second insulating layers. The resistance heating trace is configured to receive electric current and to convert the electric current to heat. The resistance heating element includes material that forms a continuous perimeter around the ink supply path opening to enable a uniform thickness for the heater around the ink supply path opening.

BRIEF DESCRIPTION OF THE DRAWINGS

The foregoing aspects and other features of the present disclosure are explained in the following description, taken in connection with the accompanying drawings, wherein.

DETAILED DESCRIPTION

Figure 1:
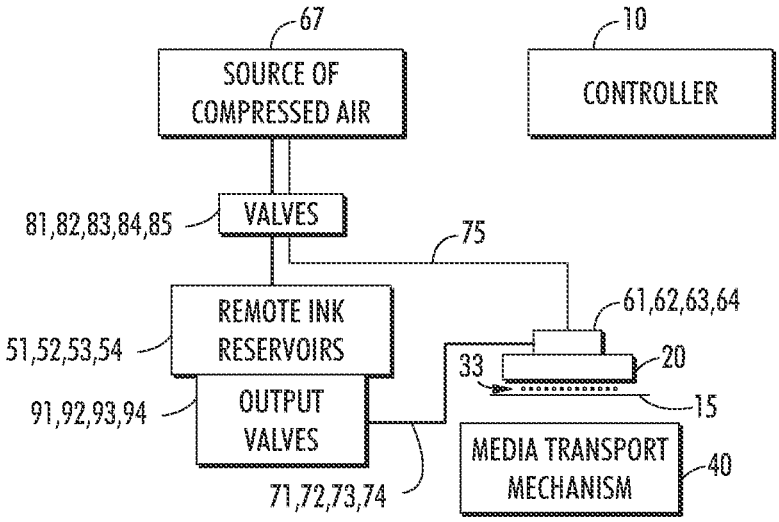
FIG. 1 is a schematic block diagram of an embodiment of an ink jet printing apparatus that includes on-board ink reservoirs.

For a general understanding of the present embodiments, reference is made to the drawings. In the drawings, like reference numerals have been used throughout to designate like elements.

As used herein, the term "imaging device" generally refers to a device for applying an image to print media. "Print media" can be a physical sheet of paper, plastic, or other suitable physical media or substrate for images. The imaging device may include a variety of other components, such as finishers, paper feeders, and the like, and may be embodied as a copier, printer, or a multifunction machine. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like.

Figure 3:
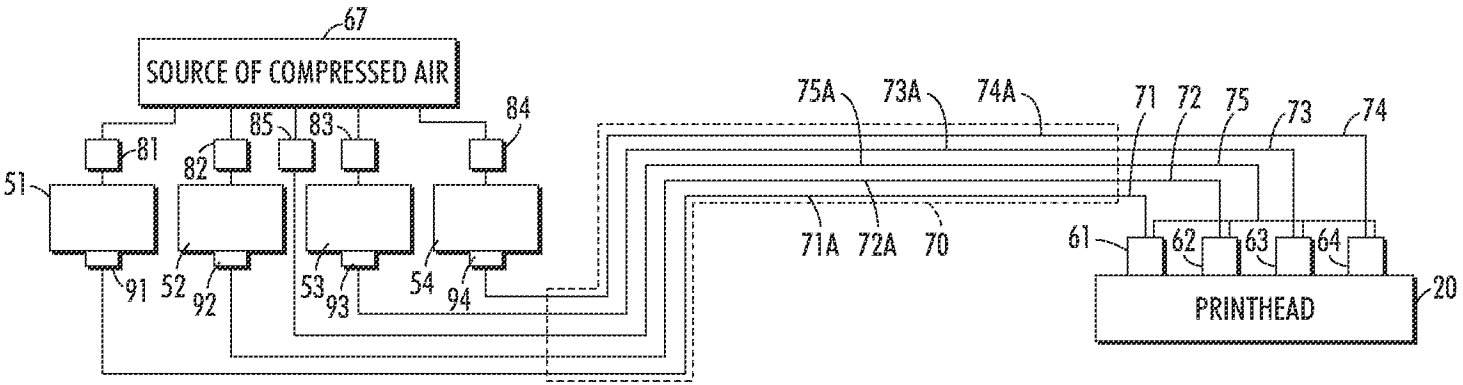
FIG. 3 is a schematic block diagram of an embodiment of ink delivery components of the ink jet printing apparatus of FIGS. 1 and 2.

FIGS. 1 and 3 are schematic block diagrams of an embodiment of an ink jet printing apparatus that includes a controller 10 and a printhead 20 that can include a plurality of drop emitting drop generators for emitting drops of ink 33 onto a print output medium 15. A print output medium transport mechanism 40 can move the print output medium relative to the printhead 20. The printhead 20 receives ink from a plurality of on-board ink reservoirs 61, 62, 63, 64 which are attached to the printhead 20. The on-board ink reservoirs 61-64 respectively receive ink from a plurality of remote ink containers 51, 52, 53, 54 via respective ink supply channels 71, 72, 73, 74.

Figure 2:
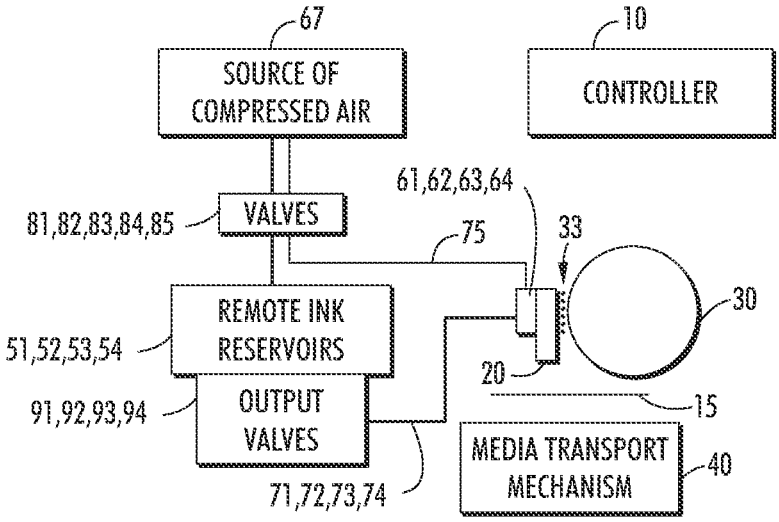
FIG. 2 is a schematic block diagram of another embodiment of an ink jet printing apparatus that includes on-board ink reservoirs.

Although not depicted in FIGS. 1-3, ink jet printing apparatus includes an ink delivery system for supplying ink to the remote ink containers 51-54. In one embodiment, the ink jet printing apparatus is a phase change ink imaging device. Accordingly, the ink delivery system comprises a phase change ink delivery system that has at least one source of at least one color of phase change ink in solid form. The phase change ink delivery system also includes a melting and control apparatus (not shown) for melting or phase changing the solid form of the phase change ink into a liquid form and delivering the melted phase change ink to the appropriate remote ink container.

The remote ink containers 51-54 are configured to communicate melted phase change ink held therein to the on-board ink reservoirs 61-64. In one embodiment, the remote ink containers 51-54 may be selectively pressurized, for example by compressed air that is provided by a source of compressed air 67 via a plurality of valves 81, 82, 83, 84. The flow of ink from the remote containers 51-54 to the on-board reservoirs 61-64 can be under pressure or by gravity, for example. Output valves 91, 92, 93, 94 may be provided to control the flow of ink to the on-board ink reservoirs 61-64. The term "remote ink container" or equivalent, suggests a separating distance, as is often illustrated, however the term is intended to apply to the functional relationship as well and thus applies equally to close positioning, integration or assembly into a single unit.

The on-board ink reservoirs 61-64 may also be selectively pressurized, for example by selectively pressurizing the remote ink containers 51-54 and pressurizing an air channel 75 via a valve 85. Alternatively, the ink supply channels 71-74 can be closed, for example by closing the output valves 91-94, and the air channel 75 can be pressurized. The on-board ink reservoirs 61-64 can be pressurized to perform a cleaning or purging operation on the printhead 20, for example. The on-board ink reservoirs 61-64 and the remote ink containers 51-54 can be configured to contain melted solid ink and can be heated. The ink supply channels 71-74 and the air channel 75 can also be heated.

The on-board ink reservoirs 61-64 are vented to atmosphere during normal printing operation, for example by controlling the valve 85 to vent the air channel 75 to atmosphere. The on-board ink reservoirs 61-64 can also be vented to atmosphere during non-pressurizing transfer of ink from the remote ink containers 51-54 (i.e., when ink is transferred without pressurizing the on-board ink reservoirs 61-64).

FIG. 2 is a schematic block diagram of an embodiment of an ink jet printing apparatus that is similar to the embodiment of FIG. 1, and includes a transfer drum 30 for receiving the drops emitted by the printhead 20. A print output media transport mechanism 40 rollingly engages an output print medium 15 against the transfer drum 30 to cause the image printed on the transfer drum to be transferred to the print output medium 15.

As schematically depicted in FIG. 3, a portion of the ink supply channels 71-74 and the air channel 75 can be implemented as conduits 71A, 72A, 73A, 74A, 75A in a multi-conduit cable 70.

Figure 4:
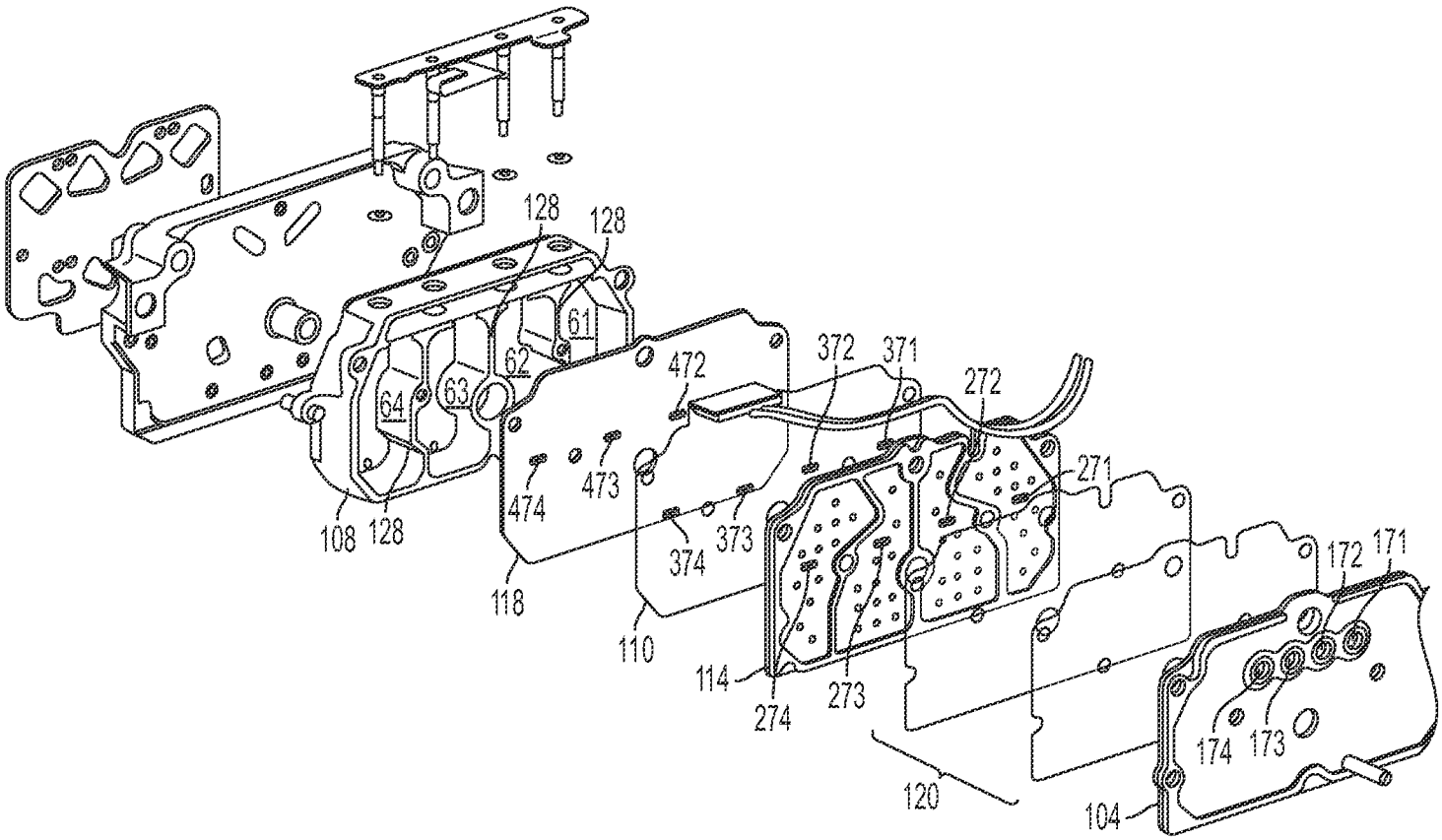
FIG. 4 is an exploded perspective view of the plates that form one embodiment of the on-board reservoirs of FIGS. 1-3.
Figure 5:
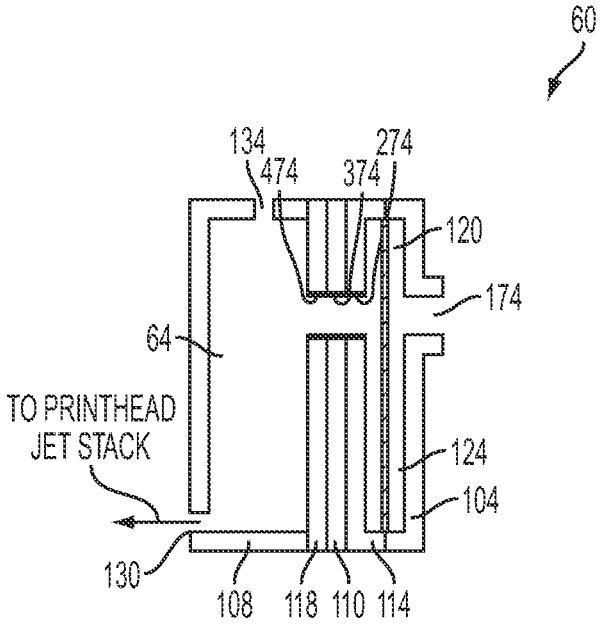
FIG. 5 is a side cross-sectional view of the on-board ink reservoir of FIG. 4.

FIGS. 4 and 5 depict an embodiment of a reservoir assembly 60 for implementing the on-board reservoirs 61, 62, 63, 64. The reservoir assembly 60 is formed of a plurality of plates or panels that are assembled to form a housing that contains ink tanks and ink supply paths. In one embodiment, the reservoir assembly includes a back panel or plate 104 and a front panel or plate 108. Located between the back panel 104 and the front panel 108 is a filter assembly 120, and then a heater sheet or panel 110 sandwiched between a first heat distribution plate 114 and a second heat distribution plate 118. The back panel 104 can generally comprise a rear portion of the reservoir assembly which 60 receives ink from the remote ink containers 51-54, while the front panel 108 includes the reservoirs 61-64 that feed the ink jets of the printhead.

The back plate 104, the first heater plate 114, the second heater plate 118, the filter assembly 120, and the front plate 108 may each be formed a thermally conductive material, such as stainless steel or aluminum, and may be bonded or sealed to each other in any suitable manner, such as by, for example, a pressure sensitive adhesive or other suitable adhering or bonding agent. The heater 110 includes heating elements that may be in the form of a resistive heat film, tape, traces, or wires which may also be of PTC (positive temperature coefficient) or NTC (negative temperature coefficient) material and that generates heat in response to an electrical current flowing therethrough. The heating elements may be covered on each side by an electrical insulation material, such as polyimide, having thermal properties and/or a negligibly thin cross section that enables the generated heat to be transferred to the plates of the reservoir assembly in adequate quantities to maintain or heat the phase change ink contained therein to an appropriate temperature. In one embodiment, the heater is configured to generate heat in a uniform gradient to maintain ink in the reservoir assembly within a temperature range of about 100 degrees Celsius to about 140 degrees Celsius. The heater 110 may also be configured to generate heat in other temperature ranges. The heater 110 is capable of generating enough heat to enable the reservoir assembly to melt phase change ink that has solidified within the passages and chambers of the reservoir assembly, as may occur when turning on a printer from a powered down state.

Generally, the ink travels from the rear plate 104 towards the front plate 108. The rear panel includes input ports 171, 172, 173, 174 that are respectively connected to the supply channels 71, 72, 73, 74 to receive ink therethrough from the associated remote ink containers 51-54 (FIGS. 1-3). Ink received via an input port is directed to a filter chamber that is formed by the adjacently positioned rear plate and first heater plate. As depicted in FIG. 5, the rear panel 104 and/or first heater plate 114 may include recesses, cavities, and/or walls that define the filter chambers 124. Each filter chamber 124 is configured to receive ink via one of the input ports 171-174 (port 174 in FIG. 5). A vertical filter assembly 120 is sandwiched between and is situated substantially parallel to the rear plate 104 and the first heater plate 114. The filter assembly generally prevents particulates from getting into the ink and causing problems with the jetting process. Particulates may clog the jets, causing them to fail or fire off axis. A vertical filter allows for a more compact print head reservoir; however, the filter can be situated at other angles as opposed to vertical. Also, the filter is very fine, so to decrease the pressure drop across the filter the surface area of the filter is maximized. A filter that is at an angle to horizontal provides a larger surface area. The filters of the filter assembly may be bonded or adhered to one of the rear panel and first heat distribution plate in any suitable manner. Alternatively, the filters of the filter assembly may be held in place by molded or otherwise formed features in the rear panel and/or first heat distribution plate, such as slots or grooves.

In the embodiment of FIGS. 4 and 5, the first heater plate 114 comprises a weir plate that includes openings 271, 272, 273, 274 that are positioned at an upper location in each of the filter chambers 124 incorporated into the reservoir assembly. The openings 271-274 in the first heater plate comprise the entrance to the ink supply paths. The heater 110 and the second heater plate 118 include corresponding openings that align with the openings in the first heater plate/weir plate to form the rest of the ink supply paths. For example, as depicted in FIG. 4, the second heater plate 118 includes ink path openings 471-474, and the heater includes ink path openings 371-374.

The ink supply paths formed by the openings in the heater and first and second heater plates guide ink received in the filter chambers 124 to an associated reservoir, or tank, 61-64 incorporated into the front panel 108, referred to herein as a tank plate. As depicted in FIG. 4, the front panel includes a plurality of tank walls 128 that extend toward the second heater plate 118 and cooperate therewith to define the reservoirs 61-64. The reservoirs 61-64 hold the ink until the printhead activates and draws ink through outlet openings in the reservoirs 61-64 that direct the ink to a jet stack where the ink may be ejected. Each reservoir includes a vent 134 that enables the reservoirs to self-regulate pressure. The jets can then draw the ink through the channel 130 without experiencing the pressure drop. In addition, the reservoir vent may be operably coupled to the air channel 75 (FIGS. 1-3) so that a positive pressure may be introduced into the reservoirs 61-64 to perform a cleaning or purging operation on the printhead.

Figure 6:
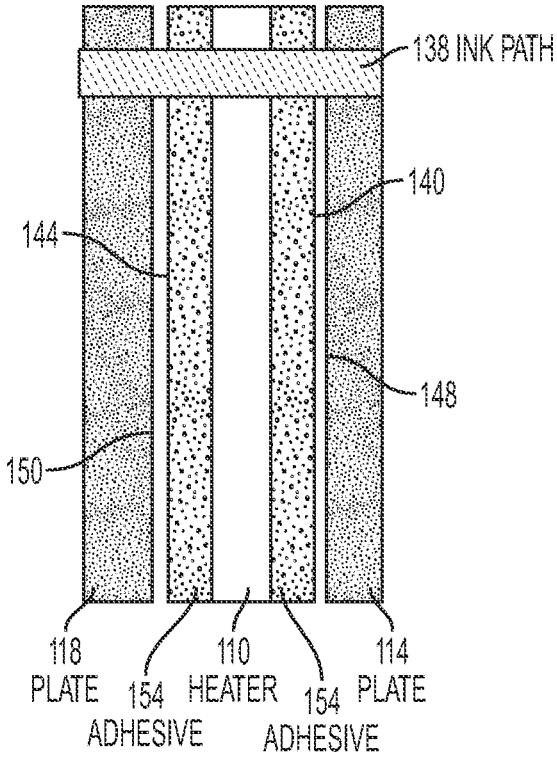
FIG. 6 is a side view showing the heater and heat distribution plates of the on-board reservoir of FIG. 4.

FIG. 6 shows the heater 110 bonded to first heat distribution plate 114 and the second heat distribution plate 118 and the resulting ink path 138 that is formed by the aligned ink supply openings in the respective plates. The heater 110 has a first side 140 and a second side 144. The first 114 and second heat distribution plates 118 each include a bonding surface 148, 150 for bonding or adhering to the first 140 and second sides 144 of the heater, respectively. The bonding surfaces of the first and second heat distribution plates may be adhered or bonded to the first and second sides of the heater, respectively, using a double-sided pressure sensitive adhesive (PSA) 154 although any suitable adhesive or bonding agent may be used. This construction enables a single heater to be used to generate heat in the substantially the entire reservoir assembly to maintain the ink within the reservoirs at a desired temperature. The heater element itself may be made up of various layers including layers of thermally conductive material which may be electrically insulated from the resistive heater element.

Figure 8:
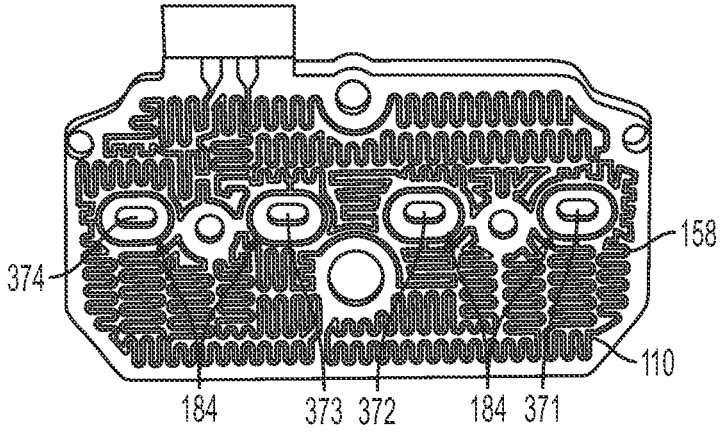
FIG. 8 is a view of the serpentine heat trace pattern of the heat trace layer of FIG. 7 showing trace rings around the ink supply path openings in the heater.

In one embodiment, the heater is formed by a heating element layer interposed between insulating layers or films. As depicted in FIG. 8, the heating element layer may be formed by a serpentine pattern of resistive heating traces 158 that are formed of a thermally conductive material such as Inconel. Other suitable materials for use as the resistive heating traces include copper, aluminum, silver, various alloys or the like. The serpentine pattern is defined herein to be any trace layout that has multiple paths of conductive material separated by adjacent spaces. The watt-density generated by the heating traces is a function of the geometry and number of traces in a particular zone as well as the thickness and width of the heat traces. In one embodiment, the watt density of the heat traces is approximately 50 watts per square inch although any suitable watt density may be utilized. After the heating traces are appropriately configured for the desired watt-density, a pair of electrical pads, each one having a wire extending from it, is coupled to the heating traces. The wires terminate in connectors so an electrical current source may be coupled to the wires to complete a circuit path through the heating traces. The current causes the heating traces to generate heat. The insulating layers or films may be formed by a suitable thermally conductive, non-electrically conductive material, such as polyimide. The heat trace layer may be bonded or adhered to the insulating layers in any suitable manner such as by an adhesive or bonding agent or material.

To keep the heater 110 from self-destructing from high localized heat, the heater may be coupled to a thermally conductive strip to improve thermal uniformity along the heater length. The thermal conductor may be a layer or strip of aluminum, copper, or other thermally conductive material adhered to at least one side of the structure formed by the bonded heating element layer and insulating layers. The thermal conductor provides a highly thermally conductive path so the thermal energy is spread quickly and more uniformly over the mass. The rapid transfer of thermal energy keeps the trace temperature under limits that would damage, preventing excess stress on the traces and other components of the assembly. Less thermal stress results in less thermal buckling of the traces, which may cause the layers of the heater to delaminate. Alternatively, a PTC film heater may be employed which may inherently provide uniform heating over the area of coverage and may additionally compensate for localized influences to non uniformity, such as end effects and fluid flow regions.

Figure 7:
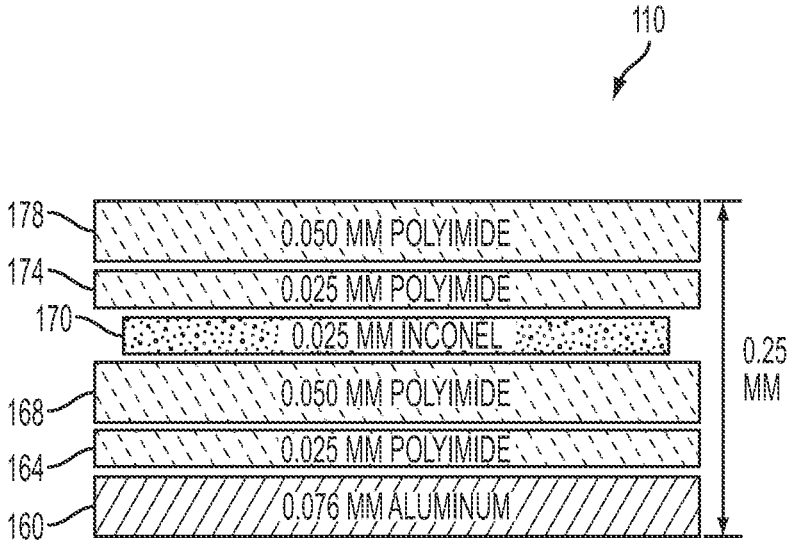
FIG. 7 is a material stack up of the heater of FIG. 6.

With reference to FIG. 7, a material stack up of a particular embodiment of the heater assembly is shown in exploded cross section and the corresponding thicknesses of the layers. The heater may be formed as a layer stack-up with the following layers from one side surface of the heater to the other: aluminum foil 160, polyimide 164, polyimide 168, Inconel 170, polyimide 174, and polyimide 178. As depicted in FIG. 7, the first polyimide insulating layer 168 is adhered to the foil by a thin polyimide adhesive layer 164. The heat trace layer 170 is then laminated or deposited onto the first insulating layer 168. The second insulating layer 178 is then adhered to the heat trace layer 170 using another thin polyimide adhesive layer 174. Once constructed, the heater may be adhered to the heat distribution plates using a PSA adhesive, for example, as depicted in FIG. 6. The material stack of the heater depicted in FIG. 7 is one exemplary embodiment. Alternate heater materials, layer configurations, etc. may be used for different temperature environments, or to address cost and geometry issues for the construction of other embodiments of the heater.

To prevent ink from leaking out of the ink supply paths, the adhesive bond or seal between the heater and bonding surfaces of the heat distribution plates must be continuous around the ink supply path openings in the plates. Because the first and second heat distribution plates may be made of a rigid material, such as stainless steel or aluminum, the bonding surfaces of the heat distribution plates may be formed or manufactured with a uniform or planar topography, at least in the areas that surround the ink supply path openings on the bonding surfaces. Thus, the flatness or planarity of the bonding surfaces of the heater around the ink supply path openings is critical to the effectiveness of the bonding between the heater and the heat distribution plates. Non-planar surface topography, such as raised or recessed areas, in the areas of the around an ink supply path opening may result in poor adhesion or bonding between the heater and heat distribution plates around the ink supply path opening which, in turn, may allow ink traveling along the ink supply path to seep between the plates. Ink leaking out of a supply path and getting between the heater and a heat distribution plate over time can weaken the adhesive bond between the plates and cause performance degradation or failure, such as in purge and jetting.

In the example of a trace style heater element, non planar surface topography in the bonding areas around the ink supply path openings in the heater may be caused by trace breaks, i.e., discontinuities or spaces between traces in the serpentine pattern of heat traces, in the heat trace layer of the heater. The heater has an overall thickness that corresponds to the thicknesses of the component layers of the heater. Thus, the overall thickness of the heater may vary between areas of the heater where the traces are located and the areas where trace breaks are located. In the embodiment of FIG. 7, the heater has an overall thickness of approximately 0.25 mm, and the heat trace layer has a thickness of approximately 0.025 mm. As a result, heater thickness is 0.25 mm where heater traces are located and 0.175 mm where trace breaks are located.

Figure 9:
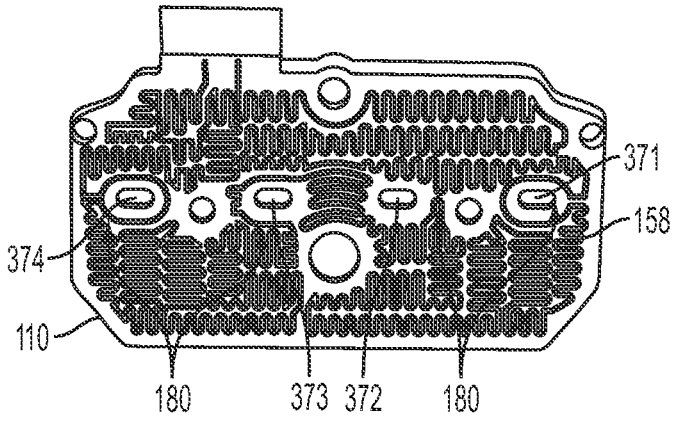
FIG. 9 PRIOR ART
FIG. 9 is a prior art view of the serpentine heat trace pattern of the heat trace layer of FIG. 7 showing trace breaks around the ink supply path openings in the heater.

In previously known designs of the heat trace pattern of the heater, the heat trace pattern typically included trace breaks 180 in an area around each ink supply path opening as in the heater as depicted in FIG. 9. Trace breaks 180 around the ink supply path openings 371-374, such as in the previous design, may cause a corresponding heater thickness variation around the ink supply path openings 371-374 which, in turn, can cause a non planar surface topography for bonding. As mentioned, a non planar surface topography around an ink supply path opening in the heater may result in poor adhesion or bonding between the heater and heat distribution plates around the ink supply path opening.

In order to address the difficulty posed by non planar surface topography around ink supply path openings in a heater that may result from trace breaks in the serpentine heat trace layer of the heater, the heat trace pattern has been modified to incorporate a trace ring around each ink supply path opening in the heater. Referring again to FIG. 8, an embodiment of a heat trace pattern showing trace rings 184 around the ink supply path openings 371-374 is illustrated. The trace rings 184 form a continuous perimeter around each ink supply path opening. The trace rings are integral with the serpentine heat trace of the heat trace layer of the heater and may be formed in the same manner as the rest of the heat trace. The trace rings are equal in thickness to the rest of the heater traces but may be a different width and may be part of the heater circuit or may be non functional.

The trace rings 184 that surround the ink supply path openings enable a constant or uniform thickness of the heat trace layer of the heater around the ink supply path openings to promote planarity of the bonding surfaces of the heater which, in turn, promotes adhesion between the heater and the heat distribution plates around the ink supply openings. Thus, ink leakage paths between the heater and the heat distribution plates may be eliminated. Other heater element configurations or materials, including wire and a continuous, predominantly continuous or discontinuous film, are to be configured with the same attention to uniform thickness encircling port openings to facilitate the required leak free assembly.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A phase change ink reservoir supplying ink to a printhead, the reservoir comprising a heater, the heater further comprising:

a first insulating layer including at least one ink supply path opening, the first insulating layer having a uniform thickness at least around the at least one ink supply path opening;

a second insulating layer including at least one ink supply path opening that aligns with the at least one ink supply path opening in the first insulating layer, the second insulating layer having a uniform thickness at least around the at least one ink supply path opening;

a resistance heating element interposed between the first and the second insulating layers, the resistance heating element being configured to receive electric current and to generate heat, the resistance heating element having an uniform material thickness along a length of the resistance heating element from a first end to a second end of the resistance heating element, a portion of the length of the resistance heating element being formed in a continuous perimeter that completely surrounds and corresponds in shape to an entire perimeter of the at least one ink supply path opening in the first and second insulating layers, the heating element being a configuration from the group comprised of uniform width traces, non uniform width traces, wires, discontinuous film and continuous film.

2. The heater of claim 1, the first and second insulating layers being formed of a material including polyimide.

3. The heater of claim 2, the resistance heating element being formed of a material from the group comprising inconel, aluminum alloy, PTC compound and NTC compound.

4. The heater of claim 3, further comprising a foil layer consisting of a material from the group comprising aluminum, copper, aluminum alloy and copper alloy, adhered to one of the first and second insulating layers, the foil layer including at least one ink supply path opening that aligns with the at least one ink supply path opening in the first and second insulating layers.

5. A phase change ink reservoir supplying ink to a printhead, the reservoir comprising a heater, the heater further comprising:

a first insulating layer including at least one ink supply path opening, the first insulating layer having a uniform thickness at least around the at least one ink supply path opening;

a second insulating layer including at least one ink supply path opening that aligns with the at least one ink supply path opening in the first insulating layer, the second insulating layer having a uniform thickness at least around the at least one ink supply path opening, and the first and second insulating layers being formed of a material including polyimide;

a resistance heating element being formed of a material from the group comprising inconel, aluminum alloy, PTC compound and NTC compound, the resistance heating element being interposed between the first and the second insulating layers and being configured to receive electric current and to generate heat, the resistance heating element having an uniform material thickness along a length of the resistance heating element from a first end to a second end of the resistance heating element, a portion of the length of the resistance heating element being formed in a continuous perimeter that completely surrounds and corresponds in shape to an entire perimeter of the at least one ink supply path opening in the first and second insulating layers, the heating element being a configuration from the group comprised of uniform width traces, non uniform width traces, wires, discontinuous film and continuous film, and the first and the second insulating layers each include four ink supply path openings that are aligned in a one-to-one correspondence when the first and the second insulating layers are bonded together with the resistance heating element interposed between the first and the second insulating layers, and the resistance heating element includes three other portions of the length of the resistance heating element, each of the three other portions of the length of the resistance heating element being configured to form a continuous perimeter that is separate from the continuous perimeters formed by the other two portions of the length of the resistance heating element, and each of the three portions of the length of the resistance heating element being positioned to surround completely one of the ink supply openings not surrounded by one of the other portions of the length of the resistance heating element.

6. A phase change ink reservoir supplying ink to a printhead, the reservoir comprising a heater, the heater further comprising:

a first insulating layer including at least one ink supply path opening, the first insulating layer having a uniform thickness at least around the at least one ink supply path opening;

a second insulating layer including at least one ink supply path opening that aligns with the at least one ink supply path opening in the first insulating layer, the second insulating layer having a uniform thickness at least around the at least one ink supply path opening, and the first and second insulating layers being formed of a material including polyimide;

a resistance heating element being formed of a material from the group comprising inconel, aluminum alloy, PTC compound and NTC compound, the resistance heating element being interposed between the first and the second insulating layers and being configured to receive electric current and to generate heat, the resistance heating element having an uniform material thickness along a length of the resistance heating element from a first end to a second end of the resistance heating element, a portion of the length of the resistance heating element being formed in a continuous perimeter that completely surrounds and corresponds in shape to an entire perimeter of the at least one ink supply path opening in the first and second insulating layers, the heating element being a configuration from the group comprised of uniform width traces, non uniform width traces, wires, discontinuous film and continuous film; and a foil layer consisting of a material from the group comprising aluminum, copper, aluminum alloy and copper alloy, the foil layer being adhered to one of the first and second insulating layers, the foil layer including at least one ink supply path opening that aligns with the at least one ink supply path opening in the first and second insulating layers, and the first insulating layer, the resistance heating element, the second insulating layer, and the foil layer being configured for bonding between a first and a second heat distribution plate of a phase change ink reservoir assembly.

* * * * *